United States Patent [19]

Templet

[11] Patent Number: 5,018,766

[45] Date of Patent: May 28, 1991

[54] METHOD OF IMPLEMENTING TRAVEL PLANNING AND PRODUCT THEREFOR

[75] Inventor: Vicki J. Templet, Buffalo Grove, Ill.

[73] Assignee: Wallace Computer Services, Inc., Hillside, Ill.

[21] Appl. No.: 551,080

[22] Filed: Jul. 11, 1990

Related U.S. Application Data

[63] Continuation-in-part of Ser. No. 466,075, Jan. 16, 1990, Pat. No. 4,971,363.

[51] Int. Cl.[5] ..... B41L 1/20

[52] U.S. Cl. ..... 462/18; 462/17; 462/66

[58] Field of Search ..... 282/8 R, 9 R, 9 A, 11.5 R, 282/23 R, 23 A, 27 R, 26

[56] References Cited

U.S. PATENT DOCUMENTS

| | | | |
|---|---|---|---|
| 4,213,639 | 7/1980 | Absler et al. | 282/11.5 R |
| 4,300,790 | 11/1981 | Griffin | 282/23 R |
| 4,493,496 | 1/1985 | Kaluza | 282/9 R |
| 4,614,363 | 9/1986 | Breen | 282/9 R |
| 4,903,989 | 2/1990 | McCormick | 282/8 R |
| 4,936,605 | 6/1990 | Kifer | 282/9 R |

*Primary Examiner*—Douglas D. Watts
*Assistant Examiner*—Hwei-Siu Payer
*Attorney, Agent, or Firm*—Tilton, Fallon, Lungmus & Chestnut

[57] ABSTRACT

A method of implementing travel planning and product therefor which utilizes forms having printed indicia providing space for information on transportation, accommodation, car rental and the like and which is foldable to provide a convenient envelope-type construction for the receipt of airline tickets and the like, the forms being designated for office, family and traveler use.

3 Claims, 3 Drawing Sheets

FIG. 1
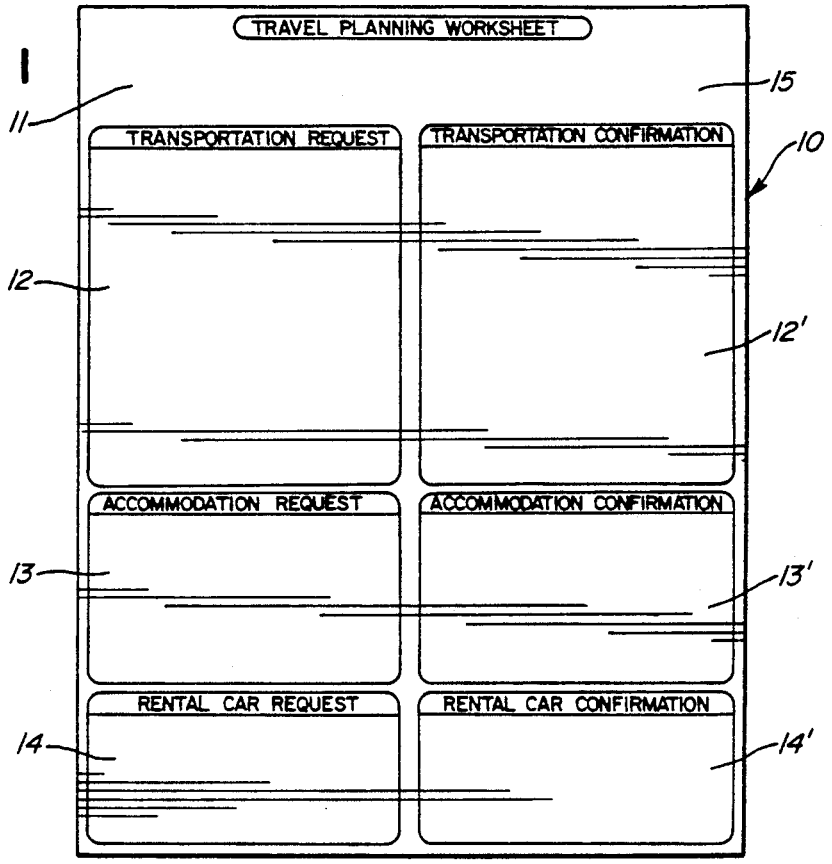
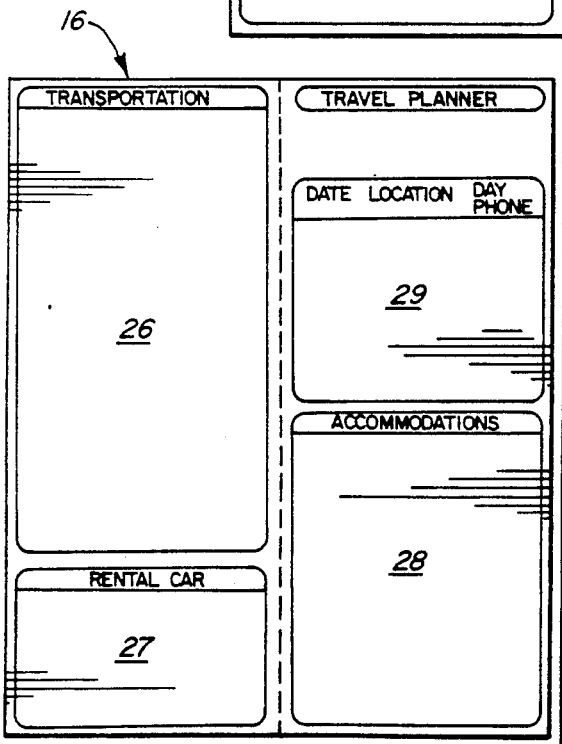
FIG. 2
FIG. 3
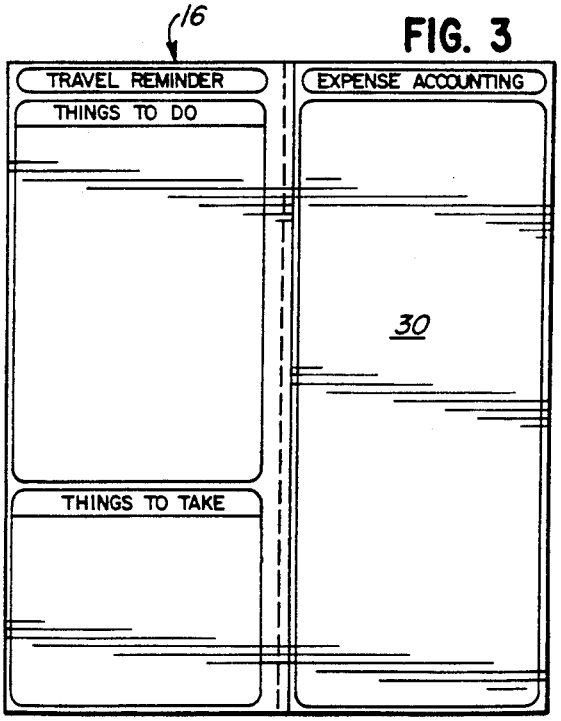

METHOD OF IMPLEMENTING TRAVEL PLANNING AND PRODUCT THEREFOR

This application is a continuation-in-part of my copending application Ser. No. 466,075 filed Jan. 16, 1990, now U.S. Pat. No. 4,971,363.

BACKGROUND AND SUMMARY OF INVENTION:

This invention relates to a method of implementing travel planning and product therefor, and, more particularly a system which tabulates in concise form information relating to transportation, accommodation, activities, expenses and the like.

Each year, sales persons and other commercial travelers fly millions of miles. A typical trip involves first traveling to the airport, then flying to the first destination, renting a car, making business calls, spending the night at a hotel/motel, making further business calls the next day, etc. This is an often repeated scenario and there is a need for packaging in a compact form all of the information the traveler needs so that he or she can go about the business at hand without being concerned about the details of travel, accommodation and the like. This is fulfilled by the instant invention which begins by entering by a traveler of information on one side of a travel arrangement request form having spaces for requesting transportation, accommodation and car rental. This then is transferred to a travel planner who enters confirmation information on an adjacent portion of the request form in alignment with the traveler's requests. After the travel planner returns the request form to the traveler, he or she enters the confirmation information on a multi-ply form assembly having printed indicia providing spaces for the previously confirmed information, the itinerary of visit location, dates and accommodations along with a reminder portion of things to do and expense accounting. Advantageously, the form assembly is developable into folded condition to carry airline tickets. Thus, all of the information required by the traveler is readily at hand.

Although U.S. Pat. No. 4,493,496 deals with travel information in a multi-ply form, the arrangement of the printed indicia providing entry spaces is substantially different in make-up and use than that of the instant invention.

Other objects and advantages of the invention may be seen in the details of the ensuing specification.

The invention is described in conjunction with the accompanying drawing, in which FIG. 1 is a top plan view of a travel planning worksheet especially advantageous for setting out the requested reservations on the left and the confirmation thereof on the right;

FIG. 2 is a top plan view of a form assembly wherein the traveler on one face enters information derived from the worksheet of FIG. 1 and also a possible itinerary;

FIG. 3 is a bottom plan view of the form assembly of FIG. 2 which provides spaces for personal information such as "THINGS TO DO", "THINGS TO TAKE", and "EXPENSE ACCOUNTING";

DETAILED DESCRIPTION

Figure 5:
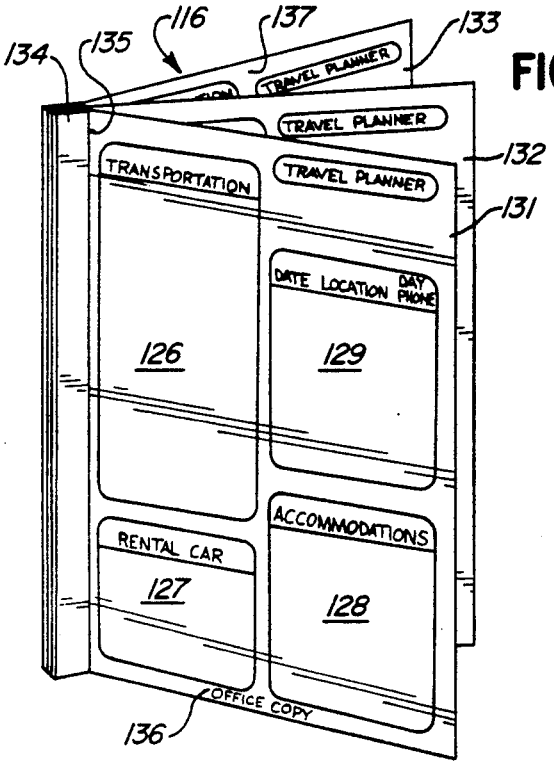
FIG. 5 is a perspective view of another embodiment of form assembly featuring information of the nature provided in the form assembly of FIGS. 2–4.

The system of the invention advantageously starts out through the use of a travel planning worksheet which may be of the type illustrated in FIG. 1 and which is designated generally by the numeral 10. In the preferred embodiment, the worksheet 10 has dimension 8½"×11" and is provided in pad form of 20 pounds per 1298.6 square foot ream of plain bond sheeting, two color printed. In use, the traveler completes the travel arrangement request section on the left side and gives the form to the travel planner/secretary. The travel planner/secretary completes the details on the right side of the form confirming plans and returns the form to the traveler.

More particularly, the left side 11 of the worksheet 10 includes a plurality of spaces dealing with requests for transportation 12, accommodations 13 and car rental 14. The right hand side 15 has similar blocks for confirmation of transportation 12', accommodation 13' and car rental 14'.

Each of the spaces 12–14, 12'–14' can be interlineated with various captions, entry line, check blocks and the like so that both the requester and the confirmor can give detailed information on such things as a limousine ride to the airport, a special meal, window/aisle preference, times of departure and arrival and preferred carrier. Like preferences and requests can also be itemized in the accommodation section and the car rental section.

FORM ASSEMBLY OF FIGS. 2–4

Figure 4:
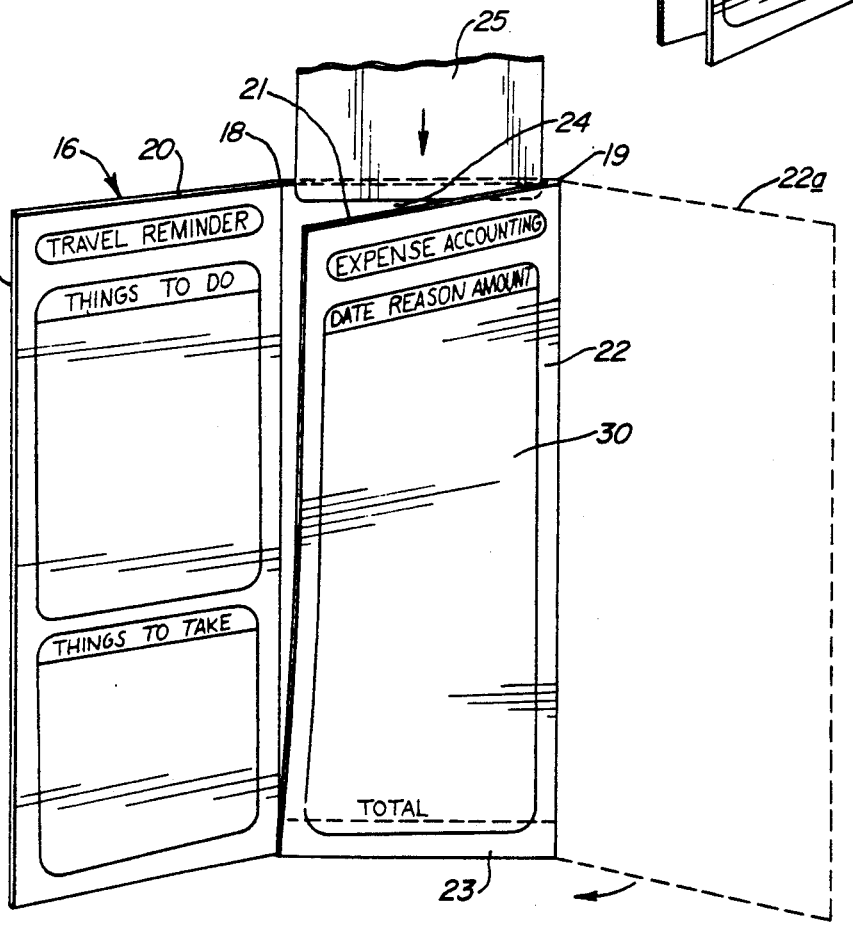
FIG. 4 is a fragmentary perspective view of the form assembly of FIGS. 2 and 3 in the process of being used by the traveler.

Reference is now made to FIGS. 2–4 which reflect a subsequent stage of the inventive travel planning and wherein a form assembly is generally designated by the numeral 16. In this embodiment of the invention, a sheet 8½" high by 11½" wide is provided of ledger stock having a ream weight of 28 pounds per 1298.6 square foot ream. As can best be appreciated from a consideration of FIG. 4 the sheet 17 has two vertically extending lines of weakness 18 and 19 provided therein so as to develop three and one-half inch panels as at 20, 21 and 22. The panel 22 along the bottom 23 thereof is adhesively secured to the panel 21 so as to form a pocket 24 which can advantageously receive a receipt 25 or the like. Again, the form assembly 16 is advantageously printed in two colors and, in this case, on both faces.

In usage, the traveler completes the details of the travel arrangements as at 26 for transportation, 27 for rental car, 28 for accommodations—see FIG. 2. Additionally, the traveler can enter in the space 29 information relating to the itinerary or calls such as DATE, LOCATION and DAY PHONE.

At the same time the front face is printed with the blanks and titles just described, a third portion **22*a*—see the right hand portion of FIG. 4 is printed with information titles relating to EXPENSE ACCOUNTING. The reverse face of the form assembly 16 is printed on the panel 20 with travel reminder information, "THINGS TO DO" and "THINGS TO TAKE". Thereafter, the third panel 22*a* is folded as indicated in FIG. 4 and adhered to the panel 21 to form the pocket 24** as previously described.

Figure 6:
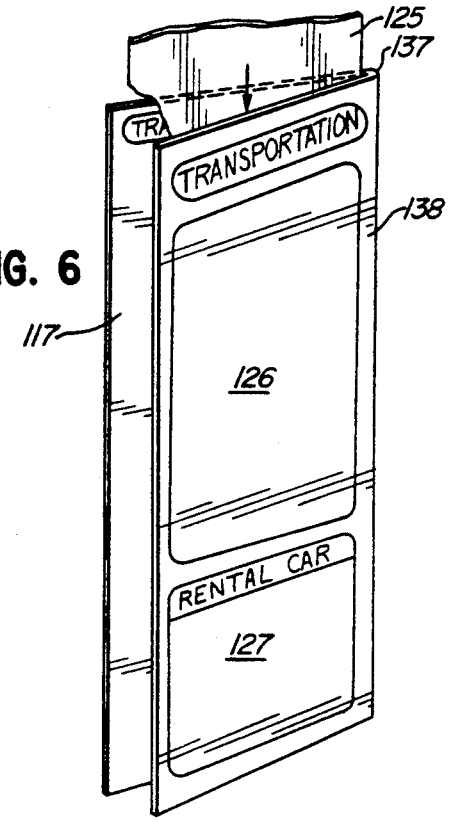
FIG. 6 is a fragmentary perspective view of the form assembly of FIG. 5 in the form of its use by a traveler.

In usage, the traveler completes the details in the spaces 26–29 for travel arrangements. The traveler also completes the travel reminder portion and as he/she incurs travel expenses, receipts as at 25 are collected in the pocket 24 while expenses may be logged in the form space 30—compare FIGS. 3 and 4. Thereafter, the form assembly is conveniently folded along the line of weakness to provide an open envelope construction for the receipt of airline tickets—much the same as is illustrated at 125 in the embodiment depicted in FIG. 6.

FORM ASSEMBLY OF FIGS. 5–7

Figure 7:
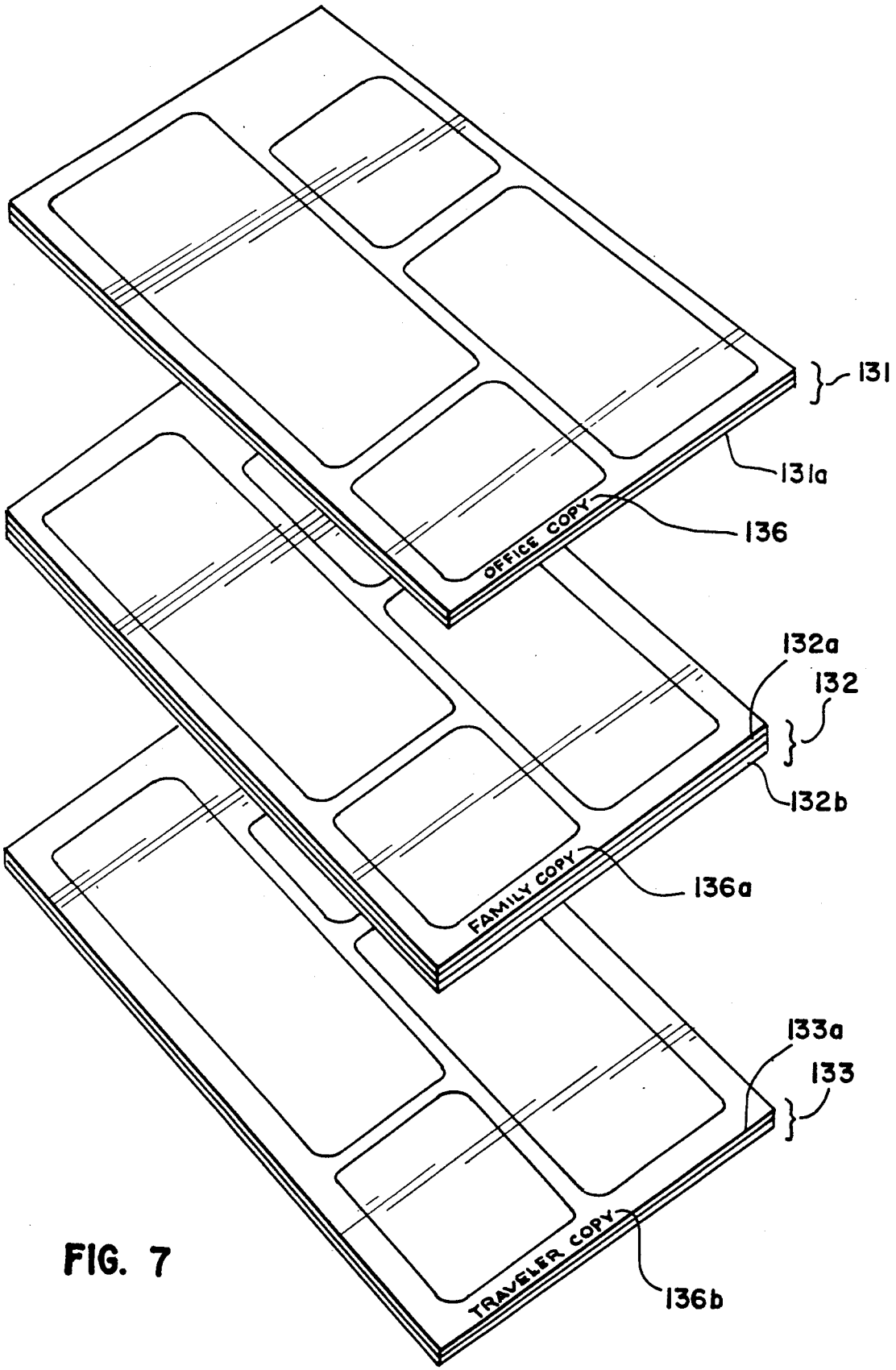
FIG. 7 is a perspective, exploded view of the form assembly of FIGS. 5 and 6.

Referring now to FIG. 5, the numeral 116 designates generally a three-part carbonless form which is equipped with information similar to that of the embodiment of FIGS. 2–4. In the illustration given in FIG. 5, the form 116 includes a top sheet 131 which advantageously is constructed of 15 pound per 1298.6 square foot ream of CB of which is printed in two colors. The carbonless back coating is designated **131*a* in FIG. 7. The second sheet 132 is advantageously 14.5 pounds CFB white printed in one color. The CF coating is designated 132*a* and the CB coating 132*b*. The third ply 133 is 33 pounds per 1298.6 square foot ream CF white printed in one color both faces with the indicia seen on the faces of the embodiment of FIGS. 3 and 4. The CF coating is designated 133*a***. The expressions "CB", "CFB", and "CF" refer to the faces which are coated with carbonless material.

The three plies 131–133 are advantageously 8½" high by 7" wide with each being equipped with an approximately ½" margin as at 134. The margins 134 are adhesively secured together and separated from the main portion of each ply by superposed lines of perforation as at 135—see FIG. 5.

In use, the traveler completes the front side of ply 131 with the details of his/her trip. Because of the carbonless nature of the form assembly 116, this information is transferred automatically to the front faces of the plies 132 and 133. The traveler then detaches the ply 131 which is advantageously marked OFFICE COPY as at 136 in FIG. 5 and distributes the ply 131 to his/her secretary or supervisor. Ply 132 is designated FAMILY COPY as at **136*a* and is distributed to his/her family for reference while the traveler is away. Ply 133 is designated TRAVELER COPY as at 136*b* in FIG. 7 and folds along a line of perforation as at 137 to create an 8½"×3½" pocket reference. As mentioned previously, airline tickets as at 125 conveniently fit in the inside of the folded traveler copy—see FIG. 6**.

Prior to detachment, the information enterable on the form assembly 116 is analogous to that previously described in conjunction with the form assembly 16 of FIGS. 2–4. For example, transportation information is enterable at 126—see FIG. 5, rental car information as at 127, accommodations as at 128 and the personal itinerary as at 129. As illustrated, the front and rear faces of the two embodiments (FIGS. 2–4 and FIGS. 5–7) are identical insofar as the printed indicia providing space for information is concerned.

On the reverse face of the ply 133, information spaces are provided analogous to those found on the inside of the folded structure of FIG. 4. For example, in referring to FIG. 6, the panel 117 has on its inside face the TRAVEL REMINDER title which is featured on the inside face of the form assembly 16 of FIG. 4. The panel 138 of FIG. 6 has on its outside face the transportation information 126, 127 and on its inside face (not shown) the expense accounting information spaces analogous to that depicted at 30 in FIG. 4.

While in the foregoing specification a detailed description of an embodiment of the invention has been set down for the purpose of illustration, many variations of the details herein given may be made by those skilled in the art without departing from the spirit and scope of the invention.

I claim:

1. A form assembly implementing travel planning comprising three superposed sheets bonded together along one side margin and selectively separable therefrom along a line of perforations, each of said sheets having front and back faces, the front face of each of said sheets having printed indicia thereon providing spaces on the left side for information on transportation and car rental and printed indicia providing spaces on the right side for information on visit locations and dates and accommodations, the front face of the top of said three sheets having printed indicia connoting an office copy and the back face of said top sheet being provided with a CB coating, the front face of the middle of said three sheets having printed indicia connoting a family copy and the front and back faces of said middle sheet being provided with CF and CB coatings, respectively, the front face of the bottom of said three sheets having printed indicia connoting a traveler copy and the front face of said bottom sheet being provided with a CF coating, and the back face of said bottom sheet having printed indicia providing spaces thereon for reminders of things to do and expense accounting.

2. The form assembly of claim 1 in which said bottom sheet has a central line of weakness whereby said bottom sheet is foldable therealong to form a folder for receipt of airline tickets.

3. The form assembly of claim 1 in which the printed indicia relating to office, family and traveler copies is located on the left side of the front faces of said sheets.

* * * * *